US007857545B2

(12) United States Patent
Burcham

(10) Patent No.: US 7,857,545 B2
(45) Date of Patent: Dec. 28, 2010

(54) VARIABLE VOLUME DRAIN FIELD SYSTEM

(75) Inventor: Timothy N. Burcham, Martin, TN (US)

(73) Assignee: Innovative Biosystems Engineering, Martin, TN (US)

( * ) Notice: Subject to any disclaimer, the term of this patent is extended or adjusted under 35 U.S.C. 154(b) by 847 days.

(21) Appl. No.: 11/566,223

(22) Filed: Dec. 3, 2006

(65) Prior Publication Data

US 2008/0128339 A1 Jun. 5, 2008

(51) Int. Cl.
*E02B 13/00* (2006.01)

(52) U.S. Cl. ..... 405/36; 405/37; 405/40; 405/53; 210/170.08

(58) Field of Classification Search ..... 405/36, 405/37, 39–41, 43, 52–53; 210/170.08
See application file for complete search history.

(56) References Cited

U.S. PATENT DOCUMENTS

| | | | | |
|---|---|---|---|---|
| 4,134,268 | A | 1/1979 | Elmore | |
| 4,501,665 | A * | 2/1985 | Wilhelmson | 210/630 |
| 4,759,661 | A | 7/1988 | Nichols et al. | |
| 4,971,690 | A | 11/1990 | Justice | |
| 5,015,123 | A | 5/1991 | Houck et al. | |
| 5,051,028 | A | 9/1991 | Houck et al. | |
| 5,290,434 | A * | 3/1994 | Richard | 210/109 |
| 5,511,903 | A | 4/1996 | Nichols et al. | |
| 5,516,229 | A | 5/1996 | Atchley et al. | |
| 5,520,481 | A | 5/1996 | Atchley et al. | |
| 5,549,415 | A | 8/1996 | Evans | |
| 5,810,509 | A | 9/1998 | Nahlik, Jr. | |
| 5,916,104 | A * | 6/1999 | Lucenet et al. | 52/791.1 |
| 6,443,652 | B1 | 9/2002 | Houck et al. | |
| 6,715,508 | B2 | 4/2004 | Schafer et al. | |
| 6,772,789 | B1 | 8/2004 | Terry, III et al. | |
| 6,786,234 | B2 | 9/2004 | Schafer et al. | |

* cited by examiner

*Primary Examiner*—David J Bagnell
*Assistant Examiner*—Benjamin Fiorello
(74) *Attorney, Agent, or Firm*—Knox Patents; Thomas A. Kulaga

(57) ABSTRACT

An apparatus for a variable volume drain field for onsite wastewater renovation. The system includes at least one module having a weir-type inlet and a one-way flow control device. The modules displace and store wastewater, and allow for differential release of the stored wastewater. The inlet is positioned adjacent the top of the module and the one-way flow control device is adjacent the bottom. In one embodiment, the module includes a pipe with caps having the inlet and one-way flow control device. In another embodiment, the module includes a container and a lid. The container includes the inlet and a one-way flow control device is connected adjacent the bottom of the container. In one embodiment, the one-way flow control device is a flexible hose with a float attached to the free end of the hose. The other end of the hose is in fluid communication with the container.

20 Claims, 7 Drawing Sheets

VARIABLE VOLUME DRAIN FIELD SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a variable volume drain field system for onsite wastewater renovation. More particularly, this invention pertains to a variable volume drain field system that displaces wastewater, stores wastewater, and has differential release of the stored wastewater.

2. Description of the Related Art

Conventional drain field systems include a trench dug into the ground. The trench contains a wastewater delivery pipe that is surrounded with aggregate. The trench is covered with earth. The wastewater delivery pipe is typically a corrugated flexible pipe with perforations that allow the wastewater to exit the pipe. The aggregate is typically rock, crushed stone, chipped tires, and/or other materials that maintain voids and allow fluid to flow or percolate through the aggregate. The aggregate prevents the sidewalls of the trench from collapsing and prevents soil intrusion into the perforations of the pipe. Such prior art drain field systems are describe in U.S. Pat. Nos. 5,015,123 and 5,549,415. One prior art variation on the standard perforated corrugated pipe for the wastewater delivery pipe is described in U.S. Pat. No. 4,134,268.

In conventional drain fields, wastewater enters the trench through the pipe, and the wastewater collects first on the trench floor where it percolates or is absorbed into the soil. If the volume of wastewater flowing into the trench is greater than the uptake capacity of the trench bottom, the wastewater begins to fill the trench. As the wastewater rises, the wastewater is absorbed by the portion of the sidewalls of the trench that are submerged. Accordingly, the trench bottom typically receives the most wastewater with the sidewalls receiving little use, until, over a period of time, the absorptive capacity of the trench bottom decreases due to anaerobic decomposition or bioslime accumulation.

Innovations have been made with respect to the conventional drain field design. U.S. Pat. No. 5,015,123 issued to Houck, et al., on May 14, 1991, and U.S. Pat. No. 5,051,028 issued to Houck, et al., on Sep. 24, 1991, both titled "Method and apparatus for installation of drainage field," disclose a corrugated perforated conduit 10 encased in a nylon netting or mesh, which is filled with an aggregation of discrete, water impervious, crush resistant lightweight elements to form a preassembled drainage line unit 20. A conduitless casing unit 30 is constructed in a similar manner, but without the conduit 10. A pair of conduitless casings 30 are placed in the bottom of trench 12 with the preassembled drainage line unit 20 placed on top of the pair of casings 30 and the trench 12 is filed with topsoil 16.

U.S. Pat. No. 5,516,229 issued to Atchley, et al., on May 14, 1996, and U.S. Pat. No. 5,520,481 issued to Atchley, et al., on May 28, 1996, both titled "Drain field system," disclose a drain field assembly 10 of a bundle of perforated pipes 20, 30 covered on top 104 and the sides 106, 108 with a protective sheeting 102. The assembly includes one or more distribution pipes 20 that deliver wastewater to the trench and the remainder are void pipes 30 that replace the aggregate normally used in trenches.

U.S. Pat. No. 6,443,652, issued to Houck, et al., on Sep. 3, 2002, titled "Aggregate chamber leach lines for leaching effluent and associated method," discloses a chamber type drainage system that includes chamber portions 38 created under a cap 32 on either side of a support member 32. The chambers 38 allow the temporary storage of excess volumes of effluent, so that the drain field does not backup by suddenly filling with wastewater when demand on the system is greatest. The chamber 38 is bounded on two sides by aggregate drainage lines 36 that include a perforated pipe encased in a mesh that is filled with a lightweight aggregate, such as disclosed in U.S. Pat. No. 5,015,123, discussed above.

Another innovation in conventional drain field design is disclosed in U.S. Pat. No. 4,759,661, issued to Nichols, et al., on Jul. 26, 1988, titled "Leaching system conduit." U.S. Pat. No. 5,511,903, issued to Nichols, et al., on Apr. 30, 1996, titled "Leaching chamber with perforated web sidewall," followed the first Nichols patent. The Nichols' leaching chamber disclosed in the first patent is a device 20 in the shape of an inverted trough, that is, it is arch-shaped in cross-section. The device 20 is buried under earth without any aggregate. Effluent 50 is delivered to the device 20 by a pipe 44 and the effluent is primarily absorbed into the soil 52 at the open bottom of the device 20 and then at the sides of the device 20 when the effluent inflow is greater than the uptake at the bottom.

Several of the above-described innovations provide for displacing the aggregate to allow greater storage capacity of the wastewater. For example, U.S. Pat. No. 5,516,229 discloses perforated pipes 30 positioned adjacent distribution pipes 20, U.S. Pat. No. 6,443,652 discloses chambers 38 free of aggregate, and U.S. Pat. No. 4,759,661 discloses a device 20 that replaces the aggregate.

However, in addition to increased storage capacity, it is also advantageous to utilize the walls of the trench and not just the bottom surface for wastewater absorption. Additionally, it is advantageous to release the stored wastewater in such a manner to maximize the surface area of the trench used to absorb the wastewater.

BRIEF SUMMARY OF THE INVENTION

According to one embodiment of the present invention, a variable volume drain field system for onsite wastewater renovation is provided. The system includes one or more variable volume drain field modules buried in a trench alongside a wastewater delivery pipe. Each module includes a weir-type inlet located as near the top of the module as is practical and a one-way flow control device for an outlet located near the bottom of the module. The module displaces volume in the trench such that a smaller volume of wastewater fills the trench as compared to other drain field systems. A full trench enhances wastewater absorption because the sides of the trench, as well as the bottom, are used for wastewater absorption. When inflow into the trench is greater than the uptake capacity of the trench and the wastewater height in the trench is maximum, wastewater flows into the module through the weir inlet, where it is stored. When the trench inflow decreases below the trench uptake capacity, the stored wastewater is released from the module through the one-way flow control device by the differential pressure (or elevation) head of wastewater stored in the module relative to the head of wastewater in the trench.

In one embodiment, the module is a pipe or other tubular member with capped ends. The capped end includes a weir-type inlet near the top and a one-way flow control device near the bottom. The inlet and the one-way flow control device are protected by a screen or other device to prevent debris (soil and/or aggregate) from entering the module. In another embodiment, the weir-type inlet includes a slot or opening in the module that is covered with a cap, or lid.

In another embodiment, the module includes an irregularly-shaped container and a lid. The container includes weir-type inlets. The lid protects the inlets from intrusion of aggregate or other trench filler. In one such embodiment, the container includes outwardly sloping walls that permit nesting of multiple containers for transport and shipping. In another such embodiment, the container includes pillars extending upwardly from the floor or base of the container. In such an embodiment, the pillars have an opening in the top that receives an anchor pin. The anchor pin has a head that engages the top of the pillar. The anchor pin is of a length sufficient to enter the soil below the container and secures the container to the bottom of the trench. In another such embodiment, the pillars have a height sufficient for supporting the lid. In one embodiment, the container includes feet or runners on the outside bottom of the container to elevate the bottom of the container from the floor or bottom of the trench.

In one embodiment, the one-way flow control device is a check valve located near the bottom of the module. In another embodiment, the one-way flow control device is a float attached to a free end of a flexible hose, which is enclosed in a housing that allows free flow of wastewater between the trench and the flexible hose. The flexible hose is in fluid communication with the bottom of the pipe. The float follows the level of wastewater in the trench. When the level, or head, of wastewater in the module is higher than the level, or head, of wastewater in the trench, wastewater flows through the flexible hose from the module into the trench until equilibrium is reached.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for a variable volume drain field system 100 is disclosed. The system 100 is suitable for onsite wastewater renovation. The system 100 includes features of displacement, storage, and differential release of the wastewater.

Figure 1:
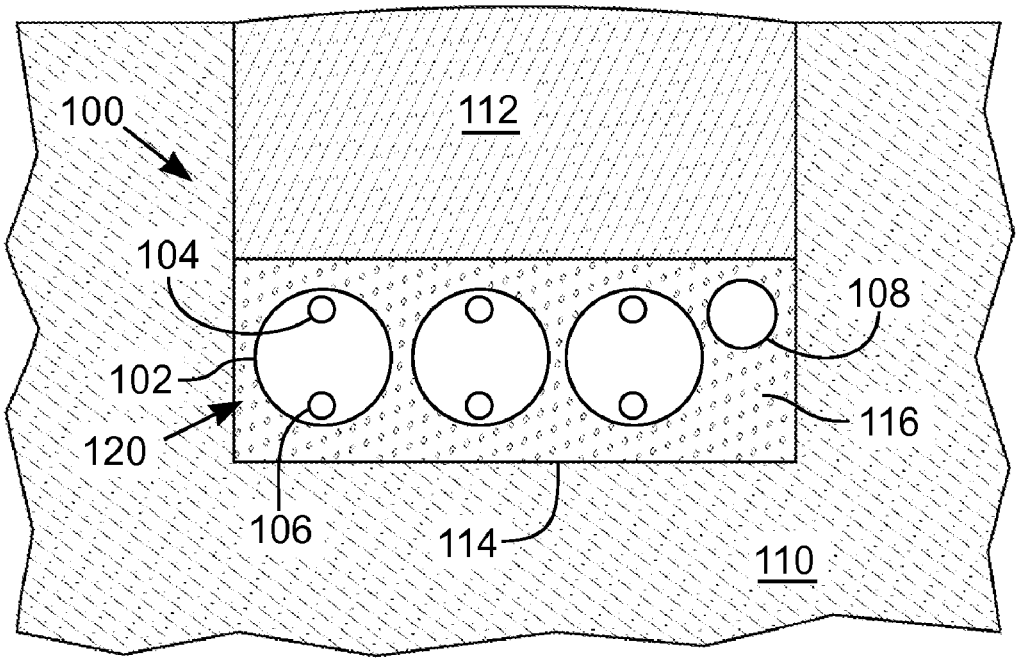
FIG. 1 is a cross-sectional view of one embodiment of a variable volume drain field system.

FIG. 1 illustrates a cross-sectional view of one embodiment of a variable volume drain field system 100. The drain field system 100 includes a trench 114 dug into soil 110. A wastewater delivery pipe 108 and, in the illustrated embodiment, three drain field modules 120 are surrounded by aggregate 116 in the trench 114. In other embodiments, the number of modules 120 varies from one module 120 to a number sufficient to meet the needs of the drain field system 100. The trench 114 is covered with top soil 112, which is compacted to provide a stable surface above the trench 114. In one embodiment, the modules 120 are anchored in the trench 114 when the weight of the top soil 112 is potentially less than the buoyant force of the modules 120. The buoyant force of the modules 120 results from empty modules 120 displacing wastewater in the trench 114.

The modules 120 are not physically connected to each other or to the wastewater delivery pipe 108. The modules 120 and the wastewater delivery pipe 108 are in fluid communication through the aggregate 116 separating the modules 120 and the delivery pipe 108. Each variable volume drain field module 120 includes a weir-type inlet 104 located near the top of a vessel, or storage member, 102. Each drain field module 120 also includes a discharge through a one-way flow control device 106 located near the bottom of the vessel 102. The one-way flow control device 106 is gravity fed by fluid contained in the vessel 102. The one-way flow control device 106 allows wastewater 304 stored in the module 120 to be released from the module 120 when the head pressure inside the module 120 is greater than the head pressure of the wastewater 304 in the trench 114 outside the module 120. In one embodiment, the one-way flow control device 106 is a check valve in fluid communication with the bottom of the vessel 102. Another embodiment of the one-way flow control device 106 includes a flexible tube 802 having a free end attached to a float 804. For optimum operation of the drain field system 100, any leakage of the one-way flow control device 106 should be at a rate less than the cumulative infiltration rate of the sidewalls 306S and bottom 306B of the trench 114.

Wastewater 304 is introduced into the drain field system 100 by the wastewater delivery pipe 108 positioned parallel to the modules 120 in the upper portion of the trench 114. The wastewater delivery pipe 108 is a perforated pipe that distributes wastewater from an effluent source to the aggregate 116 in the trench 114. In the illustrated embodiment, the wastewater delivery pipe 108 is positioned to one side of the modules 120, although in other embodiments, the wastewater delivery pipe 108 is positioned at other locations adjacent to and parallel to the modules 120. As the wastewater 304 enters the trench 114, the modules 120 displace the wastewater 304, thereby increasing the height of the level of the wastewater 304 in the trench 114 compared to traditional drain field systems. The displacement of trench volume by the modules 120 causes the 'per dose' level, or head, in the trench 114 to be greater with the modules 120 than a standard gravel trench system with the same trench size. When the level of wastewater 304 exceeds the level of the weir-type inlet 104 of the modules 120, the wastewater 304 flows into the modules 120 and is stored in the modules 120. While this is occurring, the sidewalls 306S and the bottom, or floor, 306B of the trench 114 remain in contact with the wastewater 304, and the wastewater 304 continues to be absorbed by those soil surfaces. When the level of the wastewater 304 falls, the stored wastewater 304 in the modules 120 is differentially released through the one-way flow control device 106, thereby maximizing the level of wastewater 304 in the trench 114. The efficiency and the life of the drain field system 100 is enhanced by utilizing the sidewalls 306S and the bottom 306B of the trench 114 for absorption of the wastewater 304.

In one embodiment, the trench 114 is approximately three feet across, the delivery pipe 108 is four inches in diameter, and each module vessel 102 is ten inches in diameter. The length of the modules 120 varies depending upon the design requirements of the drain field trench system 100. With the aggregate 116 being gravel with approximately 35% void volume, the drain field system 100 has a storage capacity of greater than 16 gallons per lineal foot. The capacity of this embodiment of the drain field system 100 is compared to a conventional gravel-based trench system that typically has a maximum storage capacity of 7.85 gallons per linear foot using the same gravel aggregate (35% void volume). The storage capacity for the drain field system 100 is increased relative to conventional trench systems because the module 120 has a 100% void inside, compared to the 35% void of the gravel displaced by the module 120.

Figure 2:
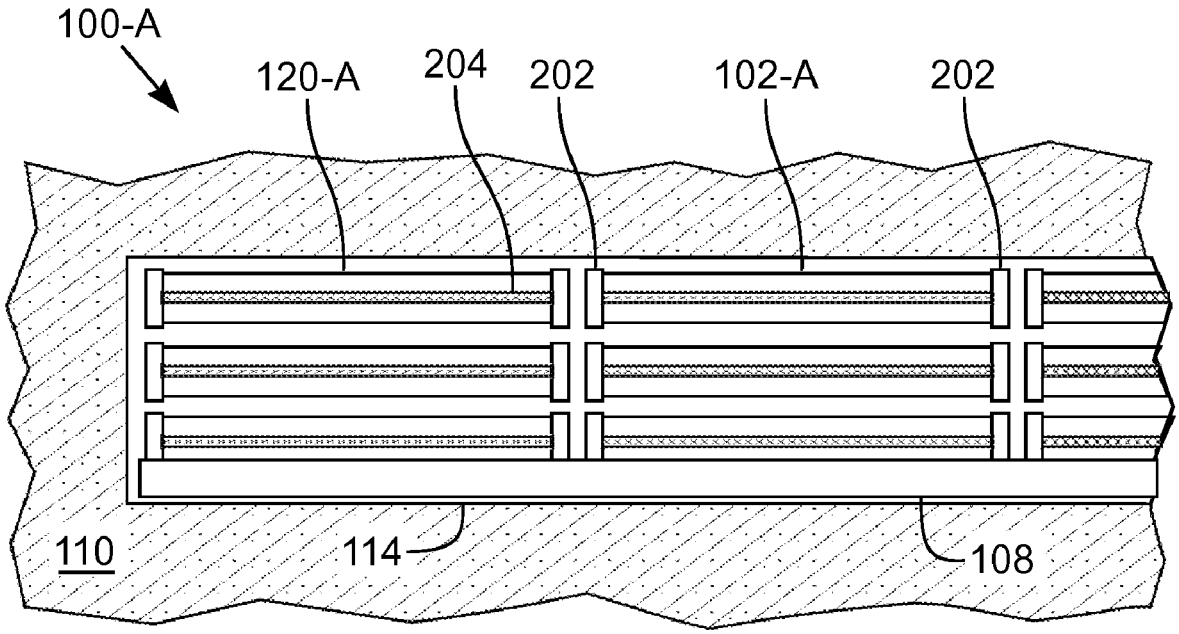
FIG. 2 is a top view of one embodiment of a variable volume drain field system.

FIG. 2 illustrates a top view of one embodiment of a variable volume drain field system 100. The trench 114 is an elongated closed-end channel in the soil 110. In the illustrated embodiment, three modules 120-A are positioned side-by-side with a number of modules 120-A positioned end-to-end. The illustrated embodiment of the modules 120-A include a cylindrical vessel 102-A with each end of the vessel 102-A having a cap 202. At least one cap 202 includes a weir-type inlet 104 and a one-way flow control device 106. In another embodiment, a cap 202 at one end of the module 120-A includes a weir-type inlet 104 and the cap 104 at the other end includes a one-way flow control device 106. On top of each vessel 102-A is a stripe or mark 204 that indicates the top of the module 120-A and ensures that the inlet 104 and one-way flow control device 106 are properly oriented in the trench 114 with the inlet 104 positioned at the top of the module 120-A.

FIGS. 3*a* to 3F illustrate symbolic views of one embodiment of a variable volume drain field system 100 showing the operational sequence for various volumes of wastewater 304 accumulation. The embodiment of the module 120-B illustrated in FIGS. 3*a* to 3*f* includes a vessel 102-B with a rectangular cross-section with a lid 302 configured to cover the top of the vessel 102-B and extend a short distance below the top surface of the vessel 102-B. The vessel 102-B has an opening in the top of the vessel 102-B that is covered by the lid 302, which allows wastewater 304 to enter the vessel 102-B.

The wastewater delivery pipe 108 is symbolically represented in the figures as a pipe 108 with an outlet connected to the trench 114. The trench 114 includes a bottom surface, or floor, 306B, a pair of opposing sidewalls 306S, and a top 306T.

The trench volume between the module 120-B and the sidewalls 306S and bottom 306B of the trench 114 contains aggregate 116, which is not illustrated in the symbolic views of FIGS. 3*a* to 3*f*. The top 306T of the trench 114 is close to the lid 302 because, unless the trench 114 is inundated with wastewater 304, the portion of the sidewalls 306S above the level of the lid 302 are not normally used to absorb wastewater 304. The module 120-B displaces the aggregate 116 in the trench 114 and it also displaces the free volume that would be available in the trench 114 if the module 120-B was not present. It is desirable to use the maximum surface area of the trench 114 to absorb wastewater 304. Accordingly, by dimensioning the module 120-B to be slightly smaller than the inside of the trench 114, a given volume of wastewater 304 introduced into the trench 114 will contact more of the surface area of the trench 114 than if the module 120-B was not present.

Figure 3A:
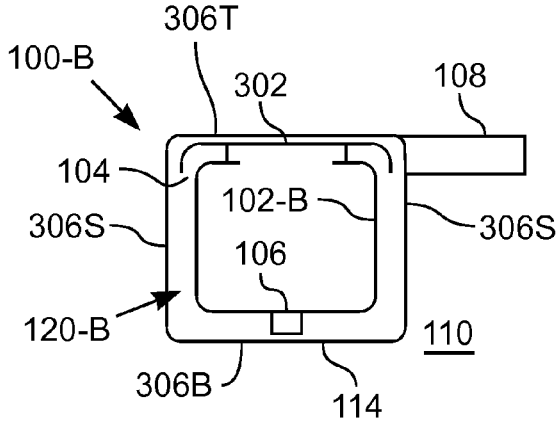
FIGS. 3*a* to 3*f* are symbolic views of one embodiment of a variable volume drain field system showing the operational sequence for various wastewater accumulation.

FIG. 3*a* illustrates a symbolic view of one embodiment of a variable volume drain field system 100 with the trench 114 empty of wastewater 304 and no wastewater 304*i* in the delivery line 108. The condition of the system 100 illustrated in FIG. 3*a* is the normal and typical condition of the system 100, that is, the system 100 is ready to accept and renovate wastewater 304.

Figure 3B:
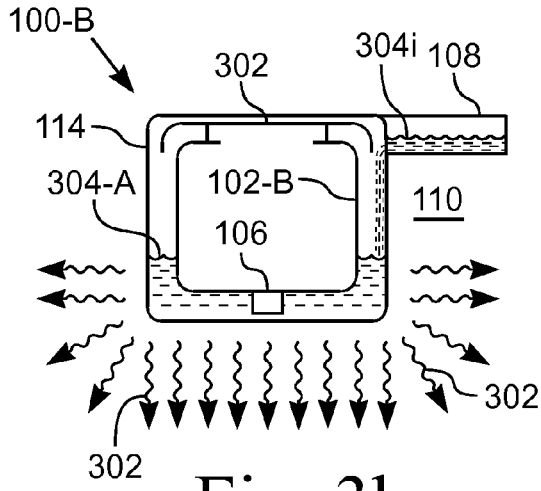

FIG. 3*b* illustrates a symbolic view of one embodiment of a variable volume drain field system 100 with wastewater 304*i* flowing into the trench 114 through the delivery line 108 and the trench 114 partially filled with wastewater 304-A. The incoming wastewater 304*i* percolates through the aggregate 116 to the bottom 306B of the trench 114. Because the module 120-B displaces the free volume of the trench 114, the wastewater 304-A quickly rises and wets the trench sidewalls 306S. A relatively small volume of wastewater 304-A results in a disproportionate level in the trench 114 because the module 120-B displaces a substantial portion of the volume of the trench 114. The wavey arrows 302 indicate the absorption of the wastewater 304 by the soil of the trench bottom 306B and a portion of the trench sidewalls 306S.

Figure 3C:
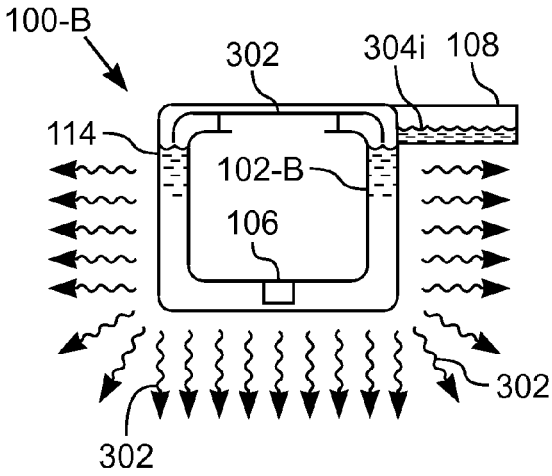

FIG. 3*c* illustrates a symbolic view of one embodiment of a variable volume drain field system 100 with wastewater 304*i* flowing into the trench 114 through the delivery line 108 and the trench 114 almost filled with wastewater 304-A. The level of the wastewater 304-A is approaching the weir-type inlet 104 of the vessel 102-B, but the wastewater 304 has not yet begun to enter the vessel 102-B of the module 120-B.

The wastewater 304-A reaches the illustrated level because the flow of incoming wastewater 304*i* is greater than the uptake of the wastewater 304-A through the sidewalls 306S and bottom 306B of the trench 114. With a relatively small volume of wastewater 304-A in the trench 114, almost the complete surface area of the sidewalls 306S is wetted with absorption 302 occurring through the wetted surfaces 306S, 306B. The displacement of the volume of the trench 114 by the module 120-B maximizes the contact of the wastewater 304-A with the absorptive soil surfaces 306S, 306B of the trench 114. The wetting of a substantial portion of the sidewalls 306S is contrasted to conventional trenches where an equal volume of wastewater 304 in a conventional trench would not wet as much of the area of the sidewalls, thereby utilizing a smaller area for absorption of the wastewater.

When the wastewater 304-A reaches the level just below the weir-type intake 104, the module 120-B is subjected to a maximum buoyancy force equal to the weight of the wastewater 304-A the module 120-B displaces. In the embodiment where the weight of the top soil 112 above the trench 114 is less than the buoyancy force of the module 120-B, the module 120-B is anchored to the trench 114. In one embodiment, the module 120-B is anchored by a strap positioned over the module 120-B with the two ends of the strap anchored in the soil 110 around the trench 114. The anchor prevents vertical displacement of the module 120-B.

Figure 3D:
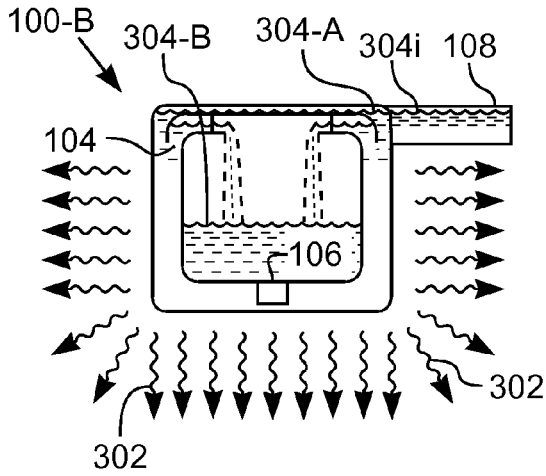

FIG. 3*d* illustrates a symbolic view of one embodiment of a variable volume drain field system 100 with wastewater 304*i* flowing into the trench 114 through the delivery line 108 and the wastewater 304-A in the trench flowing into the vessel 102-B, which is partially filled with wastewater 304-B. The opening in the top of the vessel 102-B has two edges that each form a weir-type inlet 104 to the module 120-B. As the level of the wastewater 304-A rises in the trench 114 above the weir-type inlet 104, the module 120-B begins to receive wastewater 304-B. This wastewater 304-B is stored in the module 120-B because the level of wastewater 304-A outside the module 120-B is higher than the level of wastewater 304-B inside the module 120-B. The negative differential of the two levels causes the one-way flow control device 106 to remain closed, thereby storing wastewater 304-B in the module 120-B.

The excess wastewater 304 due to the flow rate of incoming wastewater 304*i* being greater than the uptake, or absorption, 302 through the trench bottom 306-B and sidewalls 306S is stored in the module 120-B. In the illustrated embodiment, almost all the surface area of the sidewalls 306S participate in absorption 302 of the wastewater 304-A. The height of the weir-type intake 104 in the trench 114 determines the portion of the sidewalls 306S that will be wetted at the time the wastewater 304 begins to be stored in the module 120-B.

Figure 3E:
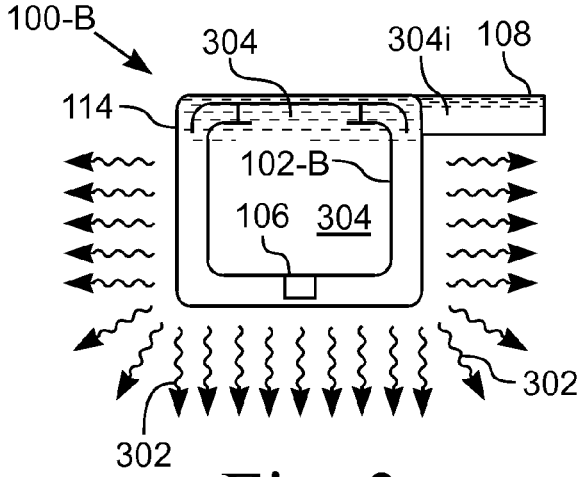

FIG. 3*e* illustrates a symbolic view of one embodiment of a variable volume drain field system 100 with the system 100 fully inundated with wastewater 304. That is, FIG. 3*e* illustrates the trench 114 and the vessel 102-B filled with wastewater 304. At this stage, the maximum amount of wastewater 304-B is stored in the module 120-B and the sidewalls 306S and bottom 306B of the trench 114 are wetted with uptake 302 of the wastewater 304-A through those surfaces 306.

Figure 3F:
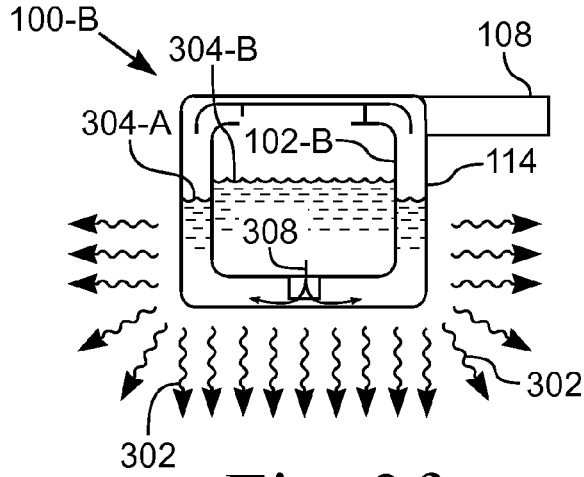

FIG. 3*f* illustrates a symbolic view of one embodiment of a variable volume drain field system 100 with the wastewater 304-B stored in the vessel 102-B being differentially released into the trench 114. At this stage, the flow of the incoming wastewater 304*i* has stopped completely or is less than the uptake 302 of the wastewater 304-A in the trench 114. Differentially releasing the volume of wastewater 304-B contained in the module, or storage member, 120-B is the release of the wastewater 304-B when the module 120-B has a positive differential pressure relative to the trench 114 outside the module 120-B.

The wastewater 304-A in the trench 114 continues being absorbed 302 through the wetted portion of the sidewalls 306S and the trench bottom 306B. As the level of wastewater 304-A outside the module 120-B falls, a differential pressure is seen by the one-way flow control device 106, which operates to release that differential pressure by allowing the wastewater 304-B inside the module 120-B to flow 308 outside the module 120-B and into the trench 114. The level of wastewater 304-B inside the module 120-B follows the falling level of wastewater 304-A outside the module 120-B. The differential release of the wastewater 304-B in the module 120-B maximizes the contact of the wastewater 304-A with the absorptive surfaces 306S, 306B of the trench 114.

Without any incoming wastewater 304*i*, the wastewater 304-A in the trench 114 will continue being absorbed 302 until the wastewater 304-B in the module 120-B drains completely and the wastewater 304-A in the trench 114 is absorbed 302, at which time the condition illustrated in FIG. 3*a* is achieved.

Figure 4:
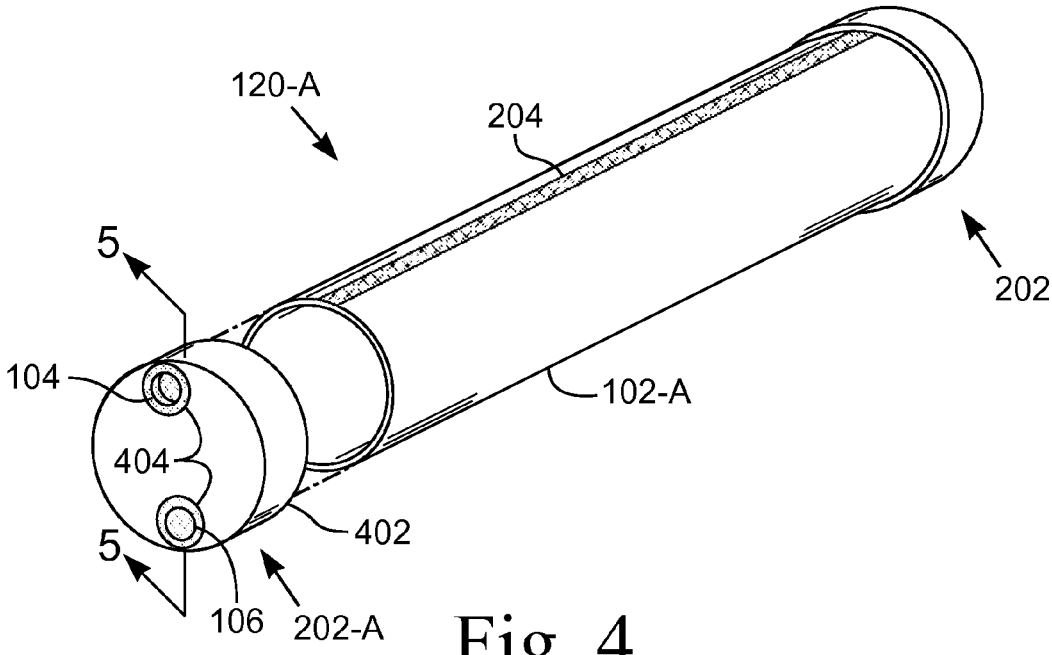
FIG. 4 is an exploded view of one embodiment of a module.

FIG. 4 illustrates a perspective exploded view of one embodiment of a variable volume drain field module 120-A. The embodiment of the module 120-A illustrated in FIGS. 2, 4, and 5 includes a cylindrical vessel 102-A, such as a PVC pipe. In another embodiment, such as illustrated in FIG. 6, the cylindrical vessel 102-A' is a corrugated pipe, such as one made of PVC. In one embodiment, the vessel 102-A and end caps 202 are made of a polyvinylchloride (PVC) material and the components 102-A, 202 are joined with an adhesive.

The illustrated embodiment of the module 120-A includes a pair of end caps 202-A. The vessel 102-A includes the end caps 202-A, which are attached to the end of the vessel 102-A with a watertight seal. Located at the upper end of the cap 202-A is the weir-type inlet 104 and located at the bottom end of the cap 202-A is the one-way flow control device 106. In the illustrated embodiment, on the outboard side of the inlet 106 and the one-way flow control device 106 are screens or meshes 404 that protect the inlet 104 and the one-way flow control device 106 from debris, soil, and/or aggregate 116.

To ensure the proper orientation of the module 120-A, a position mark or stripe 204 is aligned with the top of the end cap 202, that is, the mark or stripe 204 is positioned adjacent the weir-type inlet 104. The position stripe 204 is a colored line that indicates the upright position of the module 120-A to ensure that the module 120-A is properly oriented in the trench 114 with the inlet 104 positioned at the top of the module 120-A.

Figure 5:
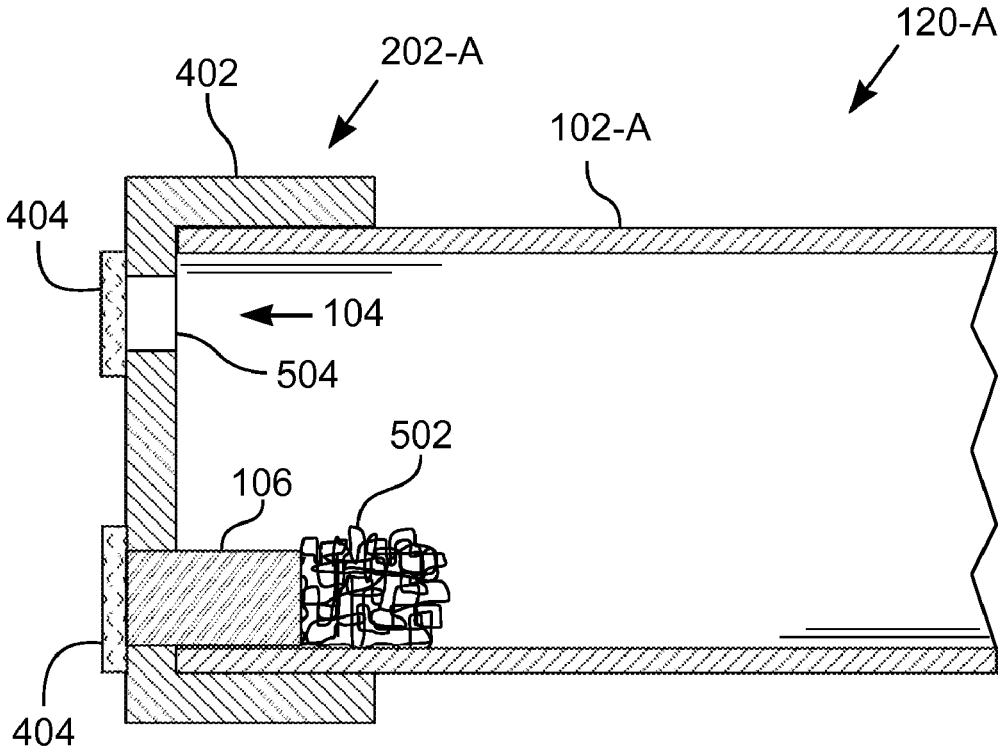
FIG. 5 is a partial cross-sectional view of one embodiment of an end cap of the module.
Figure 6:
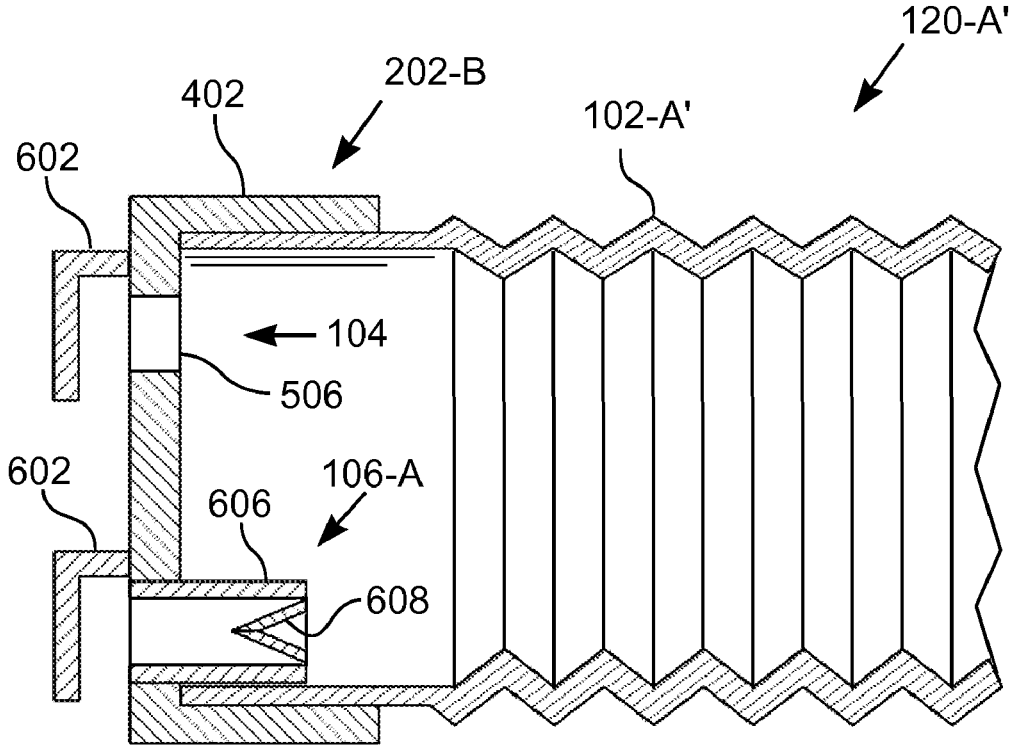
FIG. 6 is a partial cross-sectional view of another embodiment of an end cap of the module.

FIG. 5 illustrates a partial cross-sectional view of one embodiment of an end cap 202-A of the module 120-A. In the illustrated embodiment, the weir-type inlet 104 is an opening 504 near the top of the end cap 202-A. The opening 504 is protected with a mesh or screen 404 that is attached to the outside of the end cap 202-A. In another embodiment, the screen 404 is attached to the inside of the end cap 202-A. Near the bottom of the end cap 202-A is a one-way flow control device 106 that is protected on the outside by a screen or mesh 404 and on the inside by a mesh pad filter 502.

The screen or mesh 404 protecting the inlet 104 and the one-way flow control device 106 has a multitude of small openings sized to prevent the intrusion of debris and/or aggregate 116 into the module 120-A, but allow the free passage of wastewater 304 through the end cap 202-A. The mesh pad filter 502 on the inboard side of the one-way flow control device 106 offers a tortuous path for any organic tendrils in the wastewater 306 that could potentially foul the one-way flow control device 106. The mesh pad filter 502 prevents the intrusion of such tendrils into the one-way flow control device 106.

FIG. 6 illustrates a partial cross-sectional view of another embodiment of an end cap 202-B of the module 120-A. The illustrated end cap 202-B includes shrouds or louvers 602 over the opening 506 for the inlet 104 and the one-way flow control device 106. The shrouds 602 prevent the intrusion of debris, soil, and/or aggregate 116 into the module 120-A'.

In the illustrated embodiment, the one-way flow control device 106-A is a reed-type valve 608 inside a conduit 606 connected to the end cap 202-B. In various embodiments, the one-way flow control device 106 is a check valve that prevents wastewater 304 from flowing into the module 120, but allows wastewater 304 to flow out of the module 120 when there is sufficient head or positive differential pressure inside the module 120.

In the embodiment illustrated in FIG. 5, the vessel 102-A is a smooth-walled pipe. In the embodiment illustrated in FIG. 6, the vessel 102-A' is a corrugated pipe. In various embodiments, the two types of pipe 102-A, 102-A' are used with either of the screens 404 and/or the shrouds 602 and with various types of one-way flow control devices 106.

Figure 7:
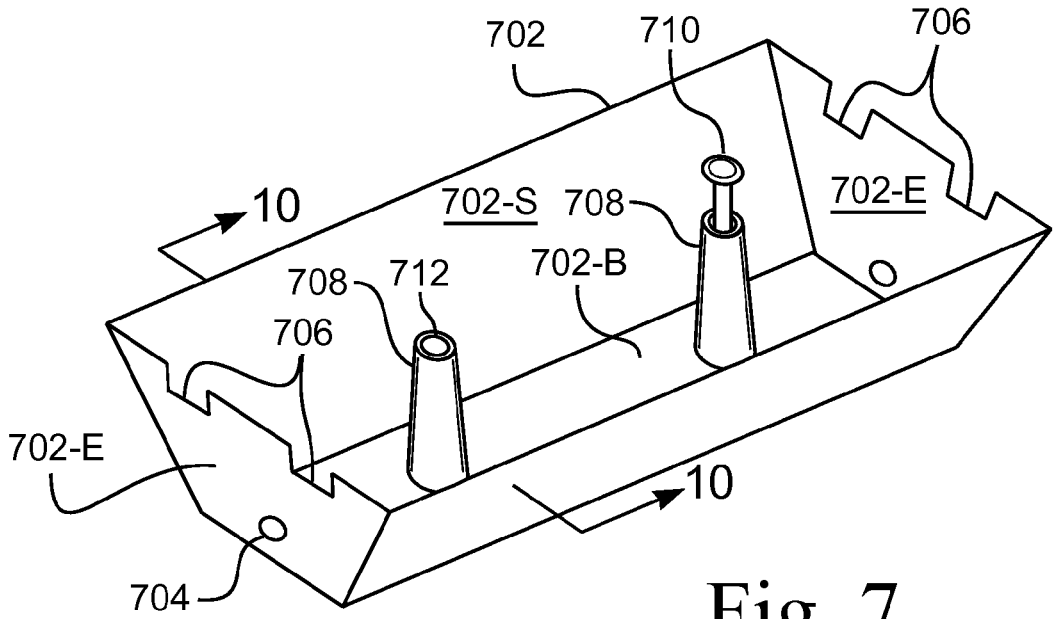
FIG. 7 is a perspective view of one embodiment of a module container.
Figure 10:
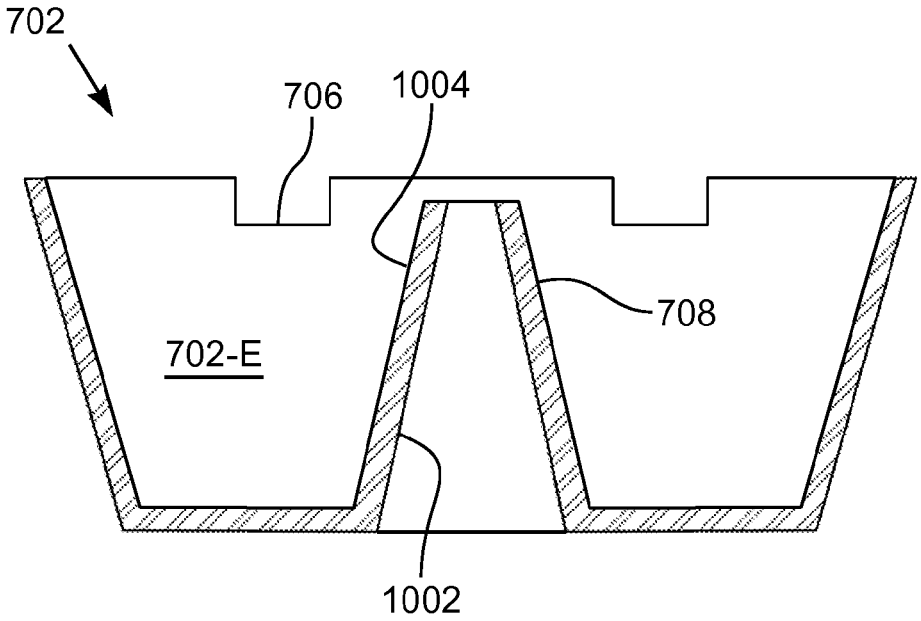
FIG. 10 is a cross-sectional view of the container of FIG. 7.

FIG. 7 illustrates a perspective view of one embodiment of a module container 702. FIG. 10 illustrates a cross-sectional view of the container 702. The illustrated module container 702 has outwardly slanted sidewalls 702-S and outwardly slated end-walls 702-E. Inside the container 702 are pillars 708 extending upward from the container floor, or bottom,

702-B. The pillars 708 include an opening 712 in the top that receives an anchor pin 710. The anchor pin 710 has a head that engages the top of the pillar 708 and the anchor pin 710 has a length sufficient to engage the soil in the bottom of the trench 114. The anchor pins 710 secure the module container 702 to the bottom of the trench 114, thereby preventing the buoyancy of the module container 702 from causing the container 702 to rise in the trench 114. In another embodiment, the pillars 708 provide support to the lid 812 when the lid 812 is placed on the container 702. The configuration of the container 702 is such that multiple containers 702 are stackable, with one container 702 nested inside another container 702. The ability to nest containers 702 allows for easy transport of a great number of containers 702 within a small space.

Figure 8:
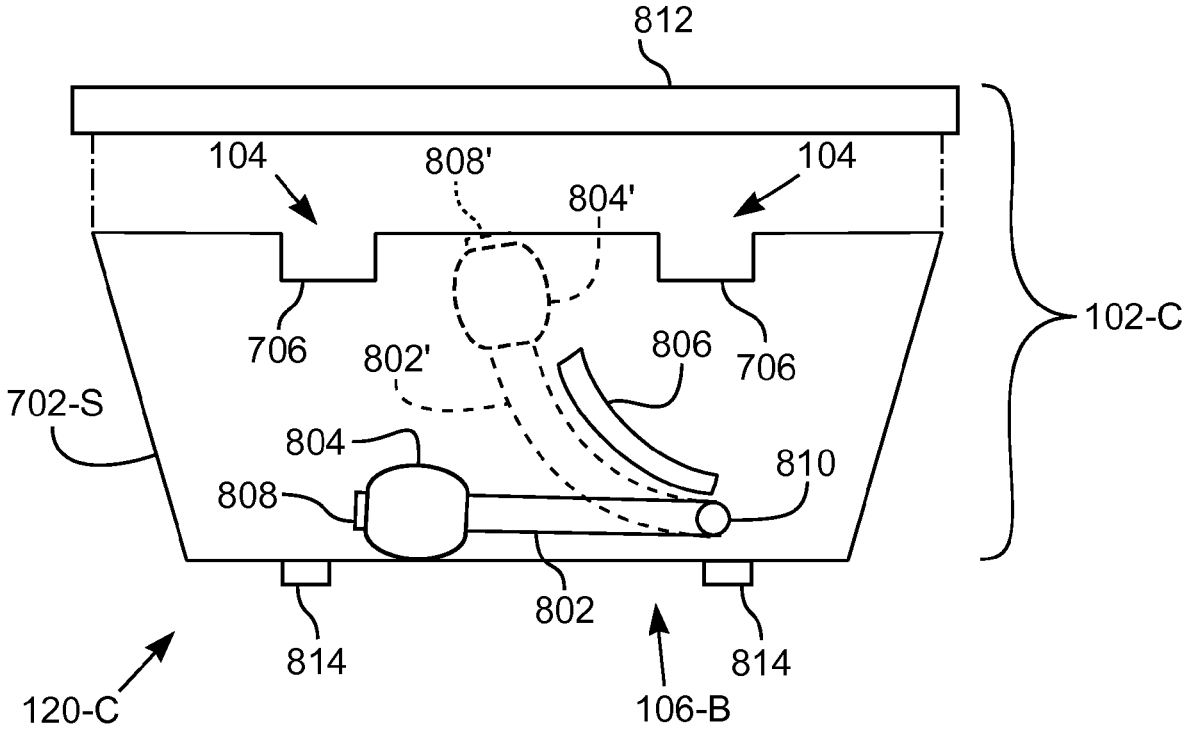
FIG. 8 is a view of one embodiment of a one-way flow control device for an embodiment of the module using the container of FIG. 7.

FIG. 8 illustrates a view of one embodiment of a one-way flow control device 106-B for an embodiment of the module 102-C using the container 702 of FIG. 7. A lid 812 fits over the top of the container 702. The container 702 and the lid 812 together form a vessel, or a storage member, 102-C.

In one embodiment, runners, or fee, 814 are positioned under the container 702 to prevent the bottom 702-B of the container 702 from resting on the soil in the bottom 306B of the trench 114. The runners 814 allow wastewater 304 to flow under the container 702 for absorption by the soil on the bottom 306B of the trench 114. The runners 814 create a surface area on the bottom 306B of the trench 114 that is open to absorption of wastewater 304 and is not covered with aggregate 116. By keeping a portion of the bottom 306B of the trench 114 free of aggregate 116 and any fines or other contaminates, the efficiency and life of the trench 114 is enhanced.

Figure 9:
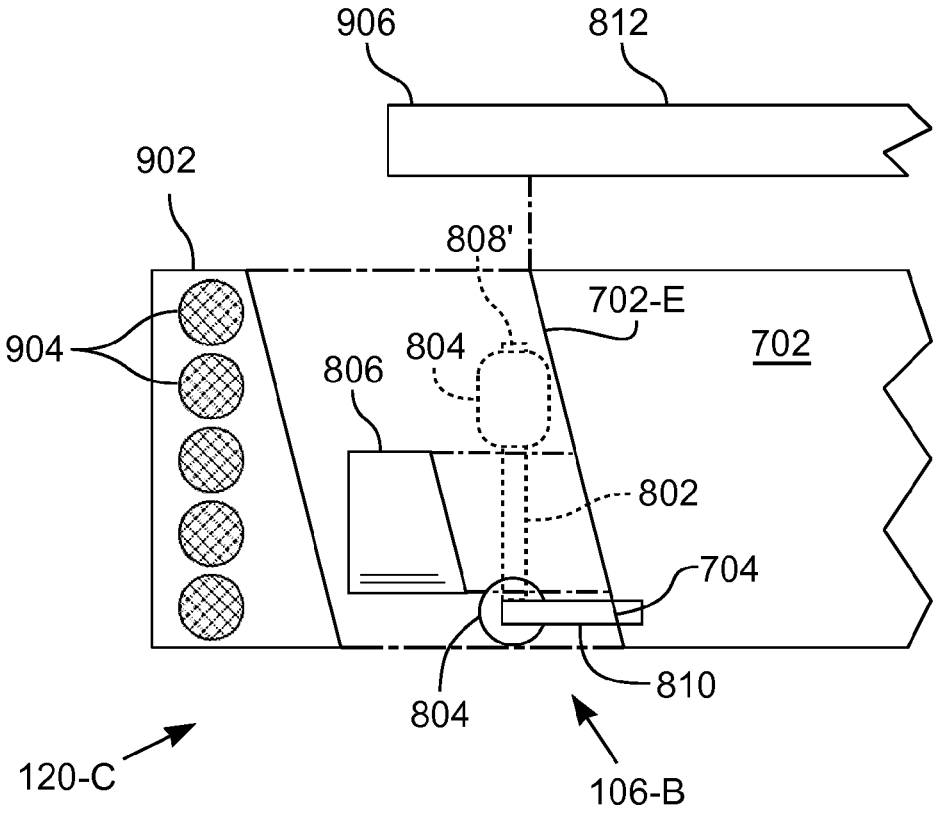
FIG. 9 is a partial exploded side view of the embodiment of the module shown in FIG. 8.

FIG. 8 illustrates an end view of one embodiment of the one-way flow control device 106-B. FIG. 9 illustrates a partial exploded side view of the one-way flow control device 106-B for the embodiment of the module 120-C shown in FIG. 8. The one-way flow control device 106-B is protected with a cover 902 at fits against the end of the container 702. The cover 902 includes a multitude of openings 904 that allow the free passage of wastewater 304 and prevent the intrusion of debris and aggregate 116. In the illustrated embodiment, the openings 904 have a mesh that is sized to prevent intrusion of aggregate 116. In other embodiments, the openings 904 are protected with shrouds or louvers, such as illustrated in FIG. 6.

The end-walls 702-E of the container 702 include notches 706 that form weir-type inlets 104. The notches 706 are located at the top edge of the end-walls 702-E. The end 906 of the lid 812 extends over the notches 706 and the cover 902 for the one-way flow control device 106-B. In one embodiment, the lid 812 is attached to the container 702 with fasteners.

Located at the bottom of each end-wall 702-E of the container 702 is an opening 704. One end of a conduit 810 is connected to the opening 704 and forms a water-tight seal with the container 702. The other end of the conduit 810 is connected to one end of a flexible hose 802. The opposite end of the flexible hose 802 has a float 804. The flexible hose 802 provides a fluid connection between the inside and outside of the module 120-C. With no wastewater 304 in the trench 114, the flexible hose 802 is in a relaxed, horizontal position. As the wastewater 304-A level rises in the trench 114, the float 804 lifts the outboard end 808 of the flexible hose 802' into the up or floating position, keeping it above the wastewater 304-A level. The guide 806 has a rounded surface that is adjacent the flexible hose 802' when the hose 802' is in the up or floating position. The guide 806 prevents the hose 802' from developing a kink when the tube 802' flexes when in the up position.

When the wastewater 304-A level in the trench 114 falls, the float 804' follows the water level. When the level of the wastewater 304-B in the module 120-C is above the level of the wastewater 304-A in the trench 114, the wastewater 304-B in the module 120-C flows through the conduit 810, through the flexible hose 802, and through the outboard end 808 of the flexible hose 802 into the trench 114. The float 804 keeps the outboard end 808 of the hose 802 slightly above the surface of the wastewater 304-A in the trench 114. Whenever the wastewater 304-B in the module 120-C is at a level equal to or higher than the outboard end 808 of the hose 808, the wastewater 304-B flows out of the module 120-C with a differential release.

Figure 11:
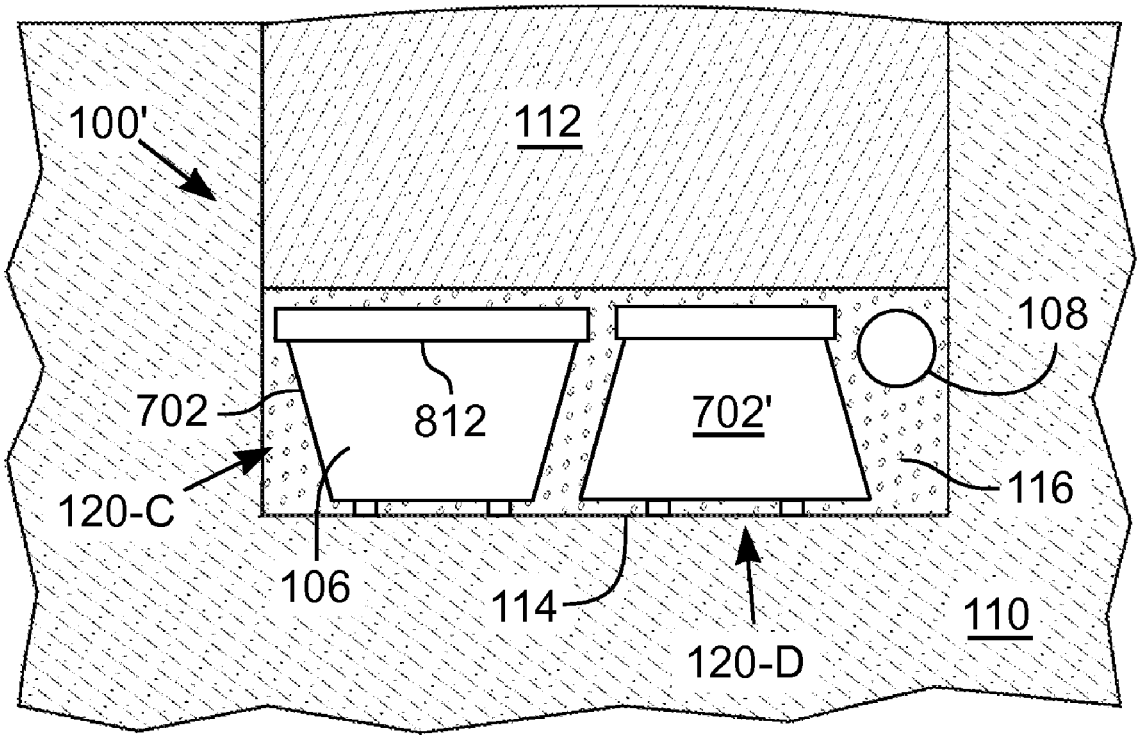
FIG. 11 is cross-sectional view of another embodiment of a variable volume drain field system.

FIG. 11 illustrates a cross-sectional view of another embodiment of a variable volume drain field system 100'. In the illustrated embodiment, one embodiment of a first module 120-C as illustrated in FIGS. 7-10 is positioned in the trench 114. Adjacent that module 120-C is another embodiment of a module 120-D. The second module 120-D has a container 702' with an inverted shape, that is, the container 702' is wider at the bottom than at the top.

The variable volume drain field system 100 includes various functions. The function of displacement of the aggregate 116 is implemented, in one embodiment, by the drain field module 120 displacing the aggregate 116 in the trench 114. The aggregate 116, because it includes solids that form voids between the solids, has less than 100% void volume, whereas, the module 120 has 100% void volume inside the module 120.

The function of displacement of the wastewater 304 is implemented, in one embodiment, by the drain field module 120 not receiving wastewater 304 until the level of the wastewater 304-A reaches the weir-type inlet 104 of the module 120. The one-way flow control device 106 prevents the wastewater 304-A from entering the bottom of the module 120.

The function of storage of the wastewater 304 is implemented, in one embodiment, by the module 120 receiving wastewater 304 at the inlet 104. The storage function occurs without causing the level of wastewater 304-A in the trench 114 outside the module 120 to fall as the module 120 fills with wastewater 304-B. Further, the one-way flow control device 106 prevents the release of the stored wastewater 304-B unless the level of stored wastewater 304-A is higher than the level of wastewater 304-B outside the module 120.

The function of differential release of the wastewater 304 without allowing entry of the wastewater 304 into the vessel 102 is implemented, in one embodiment, by the one-way flow control device 106 releasing wastewater 304-B from the bottom of the drain field module 120. The wastewater 304-B in the module 120 flows to the trench 114 only when the level of the wastewater 304-B in the module 120 is higher than the level of the wastewater 304-A in the trench 114 outside the module 120. In other words, the differential pressure between the module 120 and the trench 114 must be sufficiently great to cause the one-way flow control device 106 to operate to allow flow from the module 120 to the trench 114 outside the module 120. In one embodiment, the one-way flow control device 106 is a check valve and, in another embodiment, the one-way flow control device 106 is a float 804 attached to an end of a flexible hose 802 in fluid communication with the module 120.

From the foregoing description, it will be recognized by those skilled in the art that a variable volume drain field system 100 has been provided. The system 100 includes at least one variable volume drain field module 120 adjacent a wastewater delivery pipe 108 inside an aggregate 116 filled trench 114. The drain field module 120 displaces the aggregate 116 and also displaces the volume inside the trench 114 initially available to wastewater 304. The module 120 includes an inlet 104 that allows wastewater 304 to enter the module 120 for storage without causing the level of wastewater 304-A in the trench 114 to fall. The module 120 also includes a one-way flow control device 106 that differentially releases the wastewater 304-B in the module 120 when the level of wastewater 304-A in the trench 114 falls due to uptake 302 through the trench sidewalls 306S and the trench bottom 306B.

The variable volume drain field module 120 only stores wastewater 304-B when the rate of incoming wastewater 304*i* exceeds the absorptive rate 302 of the sidewalls 306S and the bottom 306B of the trench 114. The module 120 allows the sidewalls 306S and the bottom 306B of the trench 114 to be used more uniformly for each dosing cycle, thereby enhancing the absorptive capacity of the trench 114. Ponding on the trench bottom 306B is minimized because more absorptive area is utilized per dosing cycle. Reduced ponding maximizes aerobic environments along the surfaces 306S, 306B of the trench 114, and, consequently, reduces anaerobic environments that produce micro-flora that reduces the soil's infiltrative capacity.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for a variable volume drain field for onsite renovation of wastewater, said apparatus comprising:

a storage member configured to contain a volume of wastewater, said storage member configured to be positioned adjacent a wastewater delivery pipe in a drain field trench;

a weir inlet positioned adjacent an upper end of said storage member, said storage member receiving said volume of wastewater through said weir inlet; and a one-way flow control device in fluid communication with a lower end of said storage member, said one-way flow control device preventing fluid flow into said storage member, said one-way flow control device discharging said volume of wastewater only when said storage member has a positive differential pressure;

whereby said storage member receives said wastewater only after said drain field trench substantially fills with said wastewater, and said wastewater drains from said storage member only when said wastewater has a level in said drain field trench lower than a level of wastewater in said storage member.

2. The apparatus of claim 1 wherein said storage member is a pipe having a pair of ends, each of said pair of ends sealed with a cap, at least one of said caps including at least one of said weir inlet and said one-way flow control device.

3. The apparatus of claim 1 wherein said storage member is a pipe having a pair of ends, each of said pair of ends sealed with a cap, at least one of said caps including said weir inlet and said one-way flow control device.

4. The apparatus of claim 1 wherein said one-way flow control device is selected from a group including a check valve and a flexible hose having a first end in fluid communication with said storage member and a second end attached to a float, said float responsive to a fluid level in said drain field trench outside said storage member.

5. The apparatus of claim 1 wherein said storage member includes a container and a lid, said weir inlet in said container, said lid covering said upper end of said container.

6. The apparatus of claim 5 wherein said container includes outwardly sloping walls wherein said container is dimensioned and configured to receive a second container between said outwardly sloping walls.

7. The apparatus of claim 5 wherein said container includes at least one pillar extending upward from a floor of said container, said at least one pillar having an opening dimensioned and configured to receive an anchor pin for anchoring said container in said drain field trench.

8. The apparatus of claim 5 wherein said container includes at least one pair of feet protruding from a bottom of said container.

9. An apparatus for a variable volume drain field system for onsite renovation of wastewater, said apparatus comprising:

a storage member configured to contain a volume of wastewater, said storage member configured to be positioned adjacent a wastewater delivery pipe in a drain field trench, said storage member configured to displace wastewater in said drain field trench, a weir inlet positioned adjacent an upper end of said storage member, said storage member configured to store a volume of wastewater received through said weir inlet when the wastewater outside said storage member raises to a level where the wastewater flows over said weir inlet; and a one-way flow control device in fluid communication with a lower end of said storage member, said one-way flow control device configured to differentially release said volume of wastewater, said volume of wastewater differentially released when a level of the wastewater outside said storage member is less than a level of the wastewater inside said storage member.

10. The apparatus of claim 9 wherein said storage member is a pipe having a pair of ends, each of said pair of ends sealed with a cap, at least one of said caps including said weir inlet and said one-way flow control device.

11. The apparatus of claim 9 wherein said one-way flow control device is selected from a group including a check valve and a flexible hose, said flexible hose having a first end in fluid communication with said storage member and a second end attached to a float, said float responsive to a fluid level in said drain field trench outside said storage member.

12. The apparatus of claim 9 wherein said storage member includes a container and a lid, said weir inlet in said container, said lid covering said upper end of said container.

13. The apparatus of claim 12 wherein said container includes a plurality of outwardly sloping walls wherein said container is dimensioned and configured to receive a second container between said plurality of outwardly sloping walls, each of said plurality of outwardly sloping walls being a sidewall of said container.

14. The apparatus of claim 12 wherein said container includes at least one pair of feet protruding from a bottom of said container.

15. An apparatus for a variable volume drain field system for onsite renovation of wastewater, said apparatus comprising:

a vessel configured to contain a volume of wastewater, said vessel configured to be positioned in a drain field trench;

an inlet to said vessel, said inlet positioned adjacent a top of said vessel;

an outlet in said vessel, said outlet positioned adjacent a bottom of said vessel; and a means for differential release of said volume of wastewater through said outlet without allowing entry of the wastewater into said vessel, said means for differential release allowing release of a portion of said volume of wastewater corresponding to a level of said volume of wastewater higher than a level of the wastewater immediately outside said vessel.

16. The apparatus of claim 15 wherein said vessel is a pipe having a pair of ends, each of said pair of ends sealed with a cap, at least one of said caps including at least one of said inlet and said outlet.

17. The apparatus of claim 15 wherein said storage member includes a container and a lid, said inlet in said container, said lid covering said upper end of said container.

18. The apparatus of claim 17 wherein said container includes a plurality of outwardly sloping walls wherein said container is dimensioned and configured to receive a second container between said plurality of outwardly sloping walls, each of said plurality of outwardly sloping walls being a sidewall of said container.

19. The apparatus of claim 15 wherein said means for differential release includes a check valve.

20. The apparatus of claim 15 wherein said means for differential release includes a one-way flow control device that includes a flexible hose having a first end in fluid communication with said vessel and a second end attached to a float, said float responsive to a fluid level in said drain field trench outside said vessel.

* * * * *